United States Patent [19]

Kemmner et al.

[11] Patent Number: 4,507,063

[45] Date of Patent: Mar. 26, 1985

[54] GAS-FILLED DAMPING ELEMENT FOR DAMPING PRESSURE PULSATIONS

[75] Inventors: Ulrich Kemmner, Stuttgart; Stephan Kleppner, Bretten, both of Fed. Rep. of Germany

[73] Assignee: Robert Bosch GmbH, Stuttgart, Fed. Rep. of Germany

[21] Appl. No.: 380,011

[22] Filed: May 19, 1982

[30] Foreign Application Priority Data

Sep. 3, 1981 [DE] Fed. Rep. of Germany ..... 3134859

[51] Int. Cl.[3] ..... F04B 11/00; F16L 55/04

[52] U.S. Cl. ..... 417/540; 181/151; 138/30

[58] Field of Search ..... 417/540, 313, 312, 366, 417/542, 414; 181/151, 207; 138/31, 30; 137/207, 207.5; 24/216, 201 R; 403/289

[56] References Cited

U.S. PATENT DOCUMENTS 2,862,747 12/1958 Deliso ..... 403/289
3,551,963 1/1971 Mosher, Jr. et al. ..... 24/216
4,401,416 8/1983 Tuckey ..... 417/283

FOREIGN PATENT DOCUMENTS 2637979 3/1978 Fed. Rep. of Germany ..... 417/366

*Primary Examiner*—Carlton R. Croyle

*Assistant Examiner*—Peter M. Cuomo

*Attorney, Agent, or Firm*—Michael J. Striker

[57] ABSTRACT

A gas-filled damping element for damping pressure pulsations, especially in an internal chamber of a pumping unit for pumping liquid fuel from a fuel storage receptacle to an internal combustion engine includes a rigid support member of a substantially plate-shaped or cup-shaped configuration, and a diaphragm having a marginal portion which is sealingly secured to a border zone or rim of the support member. The surface area of the diaphragm is greater than the projected area of the support member. The enclosed space between the rigid support member and the diaphragm is filled with a gaseous medium. A support element or portion extends into the enclosed space between the diaphragm and the support member, this support element having an abutment surface of an area smaller than the projected area of the support member and facing the diaphragm. The abutment surface serves for supporting the diaphragm when the damping element is exposed to extremely high pressures. The support member is provided with male connecting formations which engage with snap action in an annular groove of an extension of a stationary axle of the pumping unit to thereby hold the damping element in a predetermined position relative to the housing of the pumping unit.

11 Claims, 3 Drawing Figures

GAS-FILLED DAMPING ELEMENT FOR DAMPING PRESSURE PULSATIONS

BACKGROUND OF THE INVENTION

The present invention relates to an arrangement for damping oscillations or pulsations in general, and more particularly to an arrangement of this type which is especially suited for use in an apparatus for pumping liquid fuel from a storage tank to an internal combustion engine of a motor vehicle.

There is already known a cushion-like damping element, in which the body of oscillation-damping gas is contained in and surrounded by a single bag-shaped diaphragm member. This damping element is capable of damping oscillations in the range of ±0.4 bar to satisfaction when used in displacement pumps. Such oscillations or pressure pulsations repeat themselves in a roller cell pump utilized as a fuel pump as often as there are mutually separated chamber volumes. Thus, in a five-cell roller cell pump, such pressure pulsations occur five times during each revolution. Each of these pumping operations is accompanied by a short-lived reduction of the negative suction pressure and a temporary increase of the pumping or output pressure. The so obtained pressure oscillations of the medium being pumped, which come into existence at the suction side as well at the pressure side of the pump and the frequency of which is determined by the rotational speed of the pump, propagate in the form of sound waves (primarily as solid-borne vibrations) and, under certain circumstances, result in a relatively high noise level of the pump.

When such noise-generating pump is a fuel pump employed in a motor vehicle or another similar mobile unit, then the main source of noise can be found in the fact that the suction and pressure side pressure variations are transmitted to and carried as solid-borne vibrations by, on the one hand, the chassis or body (on the pressure side of the pump) and, on the other hand, the fuel tank (at the suction side of the pump). These parts of the motor vehicle or other mobile unit form resonance bodies, by means of which the noise generation is considerably enhanced. From this, there results the demand for damping the oscillations as close to their source as possible or feasible. However, the aforementioned conventional damping element has the disadvantage that it can be damaged or destroyed during the fluid-tightness testing of the pumping unit when it is accommodated in the interior of such a pumping unit during the testing operation. Such testing is necessary especially when the pumping unit is not to be mounted in the interior of the storage tank, but when it is to be mounted externally thereof. The testing pressure employed in testing the pumping unit for fluid-tightness, which is usually in excess of approximately 6 bar, is well above the pressure at which the conventionally constructed damping element as discussed above retains its stability or, in other words, the strength of the diaphragm constituting the same. Hence, the conventional damping element is usually destroyed during the testing operation and hence cannot perform its damping function during the operation of the pump.

SUMMARY OF THE INVENTION

Accordingly, it is a general object of the present invention to avoid the disadvantages of the prior art.

More particularly, it is an object of the invention to provide a damping arrangement which is excellently suited for damping pressure pulsations occuring in a liquid.

Still another object of the present invention is to so construct the damping arrangement of the type here under consideration as not to possess the disadvantages of the conventional arrangements of this type.

It is yet another object of the present invention to so design the damping arrangement of the above type as to be especially suited for use in pumping units which are to be tested at high pressures for fluid leakage, without being damaged during the testing operation.

A concomitant object of the invention is to devise a damping arrangement of the above type which is simple construction, inexpensive to manufacture, easy to install, and reliable in operation nevertheless.

In pursuance of these objects and others which will become apparent hereafter, one feature of the present invention resides in an arrangement for damping oscillations, especially in a displacement pump, this damping arrangement comprising a rigid support member extending along a plane and having a border zone at such plane; a flexible diagram connected to the support member at the border zone and having a surface area exceeding the projected area of the support member into the aforementioned plane, the support member and the diaphragm defining an enclosed space between themselves; a body of gaseous medium confined in the enclosed space; and a support element rigid with the support member and extending therefrom into the enclosed space, the support element having an abutment surface facing the diaphragm and having a surface area smaller than the projected area of the support member.

When the damping arrangement is constructed in the above-mentioned manner, there is obtained the advantage not only that it has good oscillation-damping properties, but also that it can withstand pressures which lie substantially above the pressure of the pulsations which the damping arrangement is intended to suppress or attenuate. This is so because the support element engages the diaphragm when the damping element is exposed to such high pressures and the abutment surface thereof acts as a support for the diaphragm, thus preventing its excessive deformation. At the same time, the confined volume of the gaseous medium in the enclosed space of the damping arrangement or component escapes into a compensation space, that is, into the part of the enclosed space surrounding the support element, where it is compressed to such an extent that the damping element becomes stabilized.

A particularly advantageous construction of the damping arrangement according to the present invention is obtained when the support member has a substantially cup-shaped configuration including a rim constituting the border zone, a bottom wall offset normal to the aforementioned plane from the rim, and a transition zone interconnecting the bottom wall with the rim. Then, the diaphragm is advantageously situated at the convex side of the support member, is connected to the rim, and extends therefrom spacedly along the transition zone and the bottom wall. This construction has the advantage that, when the diaphragm is exposed to the above-discussed high testing pressure, it comes to rest against the transition zone and/or a part of the bottom wall after eliminating the spacing therefrom, so that it is supported thereby against the high pressure, while the gaseous medium expelled from the eliminated part of the spacing escapes into the remainder of the spacing around the support element, where it increases the prevailing pressure to such an extent as to counteract the external pressure acting on the diaphragm. The diaphragm is advantageously connected to the rim at the convex side of the substantially cup-shaped support member. This expedient achieves low cost of the arrangement and high reliability of the connection. It is particularly advantageous in this context to make the support member of a synthetic plastic material, and to use a welded connection for connecting the diaphragm to the border zone of the support member.

The aforementioned damping component is especially suited for use in pumping units, especially such which are used for pumping liquid fuel from a storage tank to an internal combustion engine of a motor vehicle, wherein the pumping unit includes a housing bounding an internal chamber containing the liquid being pumped in use, and a pumping device accommodated in the internal chamber of the housing, since it is then operative for damping any oscillations or pulsations propagating through the internal chamber of the housing. In this connection, it is especially advantageous when the damping component is accommodated in a suction compartment which is delimited in the internal chamber of the housing of the pumping unit by the pumping device. For best results, it is advantageous to further provide means for holding the damping component in position within the internal chamber, such holding means advantageously including snap-action complementary connecting means on the support member and in the housing arranged at a predetermined position relative to the latter. The connecting means of the support member may advantageously include at least two elastically yieldable projections rigid with the support member and each having a free end portion remote from the latter and having at least one engaging protuberance. Then, the connecting means of the housing may advantageously include a pin-shaped formation in the housing, the formation having an annular detaining groove receiving the protuberances of the projections of the support member in the mounted condition. When the pumping device includes a stationary axle and at least one pumping element rotatably mounted on the axle, it is advantageous when the pin-shaped formation provided with the detaining groove is constituted by an extension of the axle.

The novel features which are considered as characteristic of the invention are set forth in particular in the appended claims. The improved damping arrangement itself, however, both as to its construction and its mode of operation, together with additional features and advantages thereof, will be best understood upon perusal of the following detailed description of certain specific embodiments with reference to the accompanying drawing.

DETAILED DESCRIPTION OF THE PREFERRED EMBODIMENT

Figure 1:
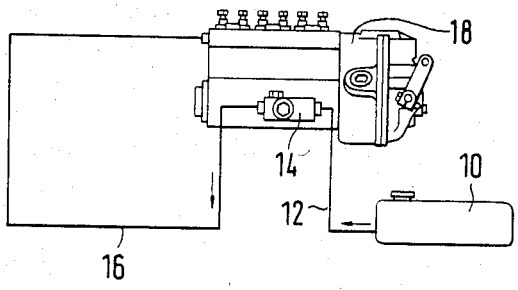
FIG. 1 is a diagrammatic side elevational view of a power plant including a fuel storage tank, a fuel pumping unit, and an internal combustion engine.

Referring now to the drawing in detail, and first to FIG. 1 thereof, it may be seen that the reference numeral 10 has been used therein to identify a fuel storage tank. A supply conduit 12 leads from the fuel storage tank 10 to the suction side of a fuel pumping unit 14. A pressure conduit 16 is connected to the pressure or output side of the fuel pumping unit 14, this pressure conduit 16 leading to an internal combustion engine 18. During the operation of the internal combustion engine 18, the fuel pumping unit 14 pumps liquid fuel from the fuel storage tank 10 to the internal combustion engine 18.

Figure 2:
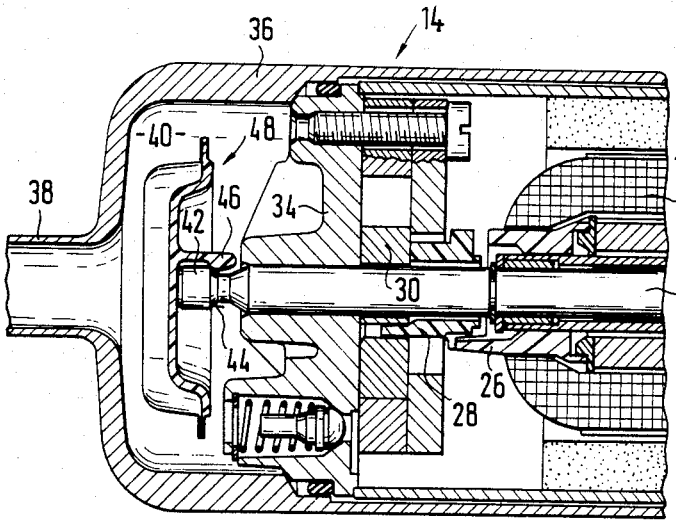
FIG. 2 is a partial axial sectional view through the fuel pumping unit of FIG. 1, at an enlarged scale relative to the latter.
Figure 3:
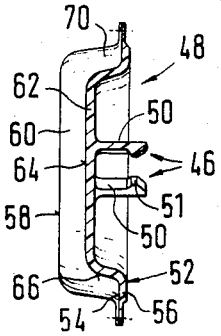
FIG. 3 is a separate partial axial sectional view through the damping component according to the present invention as used in the arrangement of FIG. 2.

As shown in FIG. 2, the fuel pumping unit 14 is equipped with an electric driving motor 20 which includes an armature 22 which is rotatably supported on a stationary axle 24. The motor armature 22 is connected via an entraining member 26 in a positive manner with an intermediate member 28, and the intermediate member 28 is in a positive or force-transmitting connection with a pumping member 30 of a pumping device 32 which is constructed as a roller cell pump. The pumping member 30 of the pumping device 32 is also rotatably mounted on the stationary axle 24. The stationary axle 24 is secured to a plate 34 which is held by a housing 36. The housing 36 surrounds the electric motor 20 as well as the fuel pumping unit 32.

The housing 36 is provided with a suction nipple 38 which is arranged at the prolongation of the stationary axle 24. The suction or inlet nipple 38 opens into a suction compartment 40 of the housing 36. The stationary axle 24 is provided with an extension 42 which extends through the plate 34 into the suction compartment 40. The extension 42 is provided with an annular detaining groove 44 which is arranged at a predetermined distance from the free end face of the extension 42. The detaining groove 44 constitutes cooperating and complementary female connecting means to male engaging or connecting means 46 of a damping component 48. The damping component is secured by means of the male connecting means 46 to the extension 42 of the stationary axle 24, which extension 42 forms a pin-shaped projection. The male connecting means are constituted by three elastically yieldable projections 50 which are rigidly connected with a rigid substantially plate-shaped support member 52, preferably by being integral or of one piece therewith. The projections 50 of the male connecting means 46 are provided at their respective free ends remote from the support member 52 with engaging protuberances or bulges 51 which engage in the annular groove 44 with snap action. The support member 52 is of a synthetic plastic material, so that the projections 50 can be directly formed on the support member 52 during the shaping of the latter.

The support member 52 has a substantially cup-shaped configuration, the male connecting means 46 being arranged at and within the concave side of the cup-shaped support member 52. A welded connection sealingly secures a marginal zone of a diaphragm 58 to a border zone or rim 56 of the cup-shaped support member 52, at a surface thereof which faces in the same direction as the convex sided of the support member 52 and which is indicated by the reference numeral 54. The surface area of the diaphragm 58 is greater than the projected area of the support member 52. Consequently, the diaphragm 58 extends from the surface 54 of the rim 56 at a spacing along an external surface 66 of a cup or transition wall 66 and a bottom surface 64 of a bottom wall 62, so that there is obtained an enclosed space 60 between the support member 52 and the diaphragm 58, this enclosed space 60 being filled with a gaseous medium. Relative to the rim or border zone 56, the bottom wall 62 of the cup-shaped support member 52 forms an elevated portion, which extends into the enclosed space 60. Herein, the bottom surface 64 of the bottom wall 62 constitutes a support surface for the diaphragm 58, when the latter is pressed by an extremely high pressure against the bottom wall 62 which acts as a support element. In such a situation, there remains a confining space 70 between the outer surface 66 of the transition wall or zone 66 and the diaphragm 58. This confining space 70 has an annular configuration and serves to accommodate the gaseous medium expelled from the spacing between the bottom wall 62 and the diaphragm 58 at the aforementioned extreme pressure. In this manner, destruction of the diaphragm 58 is avoided.

As a result of the construction of the damping component according to the present invention, there is obtained a relatively huge oscillating surface of the diaphragm 58 while the volume of enclosed gas is relatively small. In addition thereto, there is obtained a relatively voluminous compensating space 70, into which the gas contents of the damping element 48 can escape when the diaphragm 58 is pressed against the support surface 64 of the bottom wall 62 during the leakage testing of the pumping unit 14.

It will be understood that each of the elements described above, or two or more together, may also find a useful application in other types of arrangements differing from the type described above.

While the invention has been illustrated and described as embodied in a damping arrangement for a fuel pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the genric and specific aspects of our contribution to the art and, therefore, such adaptations should and are intended to be comprehended within the meaning and range of equivalence of the claims.

What is claimed as new and desired to be protected by Letters Patent is set forth in the appended claims:

1. An arrangement for damping oscillations, especially in a displacement pump, comprising a rigid support member having a border zone delimiting a base area in one plane, an abutment surface situated in another plane extending substantially parallel to said one plane, and a transition zone connecting said border zone with said abutment surface; a flexible diaphragm connected to said support member at said border zone and covering a surface area in said one plane which exceeds the area of said abutment surface in said another plane; said support member and said diaphragm defining an enclosed space between themselves; a body of gaseous medium confined in said enclosed space; said transition zone extending from said border zone into said enclosed space; said abutment surface facing toward said diaphragm and the area of said abutment surface being smaller than said base area, and wherein said support member has a convex outer side formed with a flat rim in said border zone, a bottom wall formed with said abutment surface, and a connecting wall constituting said transition zone; and wherein said diaphragm is arranged opposite the convex side of said support member, is connected to said rim, and extends therefrom spacedly along said transition zone and said bottom wall.

2. The arrangement as defined in claim 1, wherein said diaphragm is connected to said rim at said convex side of said support member.

3. The arrangement as defined in claim 1, wherein said support member is of a synthetic plastic material; and further comprising a welded connection connecting said diaphragm to said border zone of said support member.

4. An arrangement for pumping liquids, especially for pumping liquid fuel from a storage tank to an internal combustion engine of a motor vehicle, comprising a housing bounding an internal chamber containing the liquid being pumped in use; a pumping device accommodated in said internal chamber; means for damping oscillations propagating through said internal chamber, including a rigid support member extending along a plane and having a border zone delimiting a base area at said plane; a flexible diaphragm connected to said support member at said border zone and having a surface area exceeding said base area; said support member having a substantially cup-shaped configuration defining an outer side formed with a rim constituting said border zone, a bottom wall offset normal to said plane from said rim, and a transition zone interconnecting said bottom wall with said rim; and wherein said diaphragm is arranged opposite the outer side of said support member, is connected to said rim, and extends therefrom spacedly along said transition zone and said bottom wall.

5. The arrangement as defined in claim 4, wherein said diaphragm is connected to said rim at said outer side of said support member.

6. The arrangement as defined in claim 4, wherein said support member is of a synthetic plastic material; and further comprising a welded connection connecting said diaphragm to said border zone of said support member.

7. The arrangement as defined in claim 4 wherein said pumping device delimits a suction compartment in said internal space; and wherein said damping means is accommodated in said suction compartment.

8. The arrangement as defined in claim 4, and further comprising means for holding said damping means in position within said internal chamber, including snap-acting complementary connecting means on said support member and in said housing arranged at a predetermined position relative to the latter.

9. The arrangement as defined in claim 8, wherein said connecting means of said support member includes at least two elastically yieldable projections rigid with said support member end each having a free end portion remote from the latter and having an engaging protuberance.

10. The arrangement as defined in claim 9, wherein said connecting means of said housing includes a pin-shaped formation in said housing having an annular detaining groove receiving said protuberances of said projections in the mounted condition.

11. The arrangement as defined in claim 10, wherein said pumping device includes a stationary axle and at least one pumping element rotatably mounted on said axle; and wherein said pin-shaped formation provided with said detaining groove is constituted by an extension of said axle.

* * * * *